US011305320B2

(12) United States Patent
Yamane et al.

(10) Patent No.: US 11,305,320 B2
(45) Date of Patent: Apr. 19, 2022

(54) METHOD FOR PRODUCING SEAMLESS METAL PIPE

(71) Applicant: Nippon Steel Corporation, Tokyo (JP)

(72) Inventors: Kouji Yamane, Tokyo (JP); Kazuhiro Shimoda, Tokyo (JP); Yuji Inoue, Tokyo (JP); Shusuke Shimooka, Tokyo (JP); Yuichi Yamanari, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 178 days.

(21) Appl. No.: 16/619,631

(22) PCT Filed: Jun. 8, 2018

(86) PCT No.: PCT/JP2018/021960
§ 371 (c)(1),
(2) Date: Dec. 5, 2019

(87) PCT Pub. No.: WO2018/230450
PCT Pub. Date: Dec. 20, 2018

(65) Prior Publication Data

US 2020/0156132 A1 May 21, 2020

(30) Foreign Application Priority Data

Jun. 12, 2017 (JP) ..... JP2017-115418

(51) Int. Cl.
*B21C 23/08* (2006.01)
*B21B 19/04* (2006.01)
*B21C 25/08* (2006.01)

(52) U.S. Cl.
CPC ..... *B21C 23/085* (2013.01); *B21B 19/04* (2013.01); *B21C 25/08* (2013.01)

(58) Field of Classification Search
CPC ..... B21B 19/02; B21B 19/03; B21B 19/04; B21B 19/05; B21B 19/06; B21B 25/00
(Continued)

(56) References Cited

U.S. PATENT DOCUMENTS

2010/0175450 A1* 7/2010 Shimoda ..... B21B 23/00 72/97

FOREIGN PATENT DOCUMENTS

JP H07-214113 A 8/1995
JP H07214113 * 8/1995 ..... B21B 19/04
(Continued)

OTHER PUBLICATIONS

JH07214113 Kobayashi, et alia (Aug. 18, 1995) MT (Year: 1995).*
(Continued)

*Primary Examiner* — Adam J Eiseman
*Assistant Examiner* — Fred C Hammers
(74) *Attorney, Agent, or Firm* — Banner & Witcoff, Ltd.

(57) ABSTRACT

A method for producing a seamless metal pipe includes the steps of: preparing a billet having a diameter (B); heating the billet; forming, in a center part of a rear end of the heated billet, a hole including four grooves extending in an axial direction of the billet, the grooves each having a groove width (D) satisfying Formula (1), a groove height (H) satisfying Formula (2), and a groove depth (L1) satisfying Formula (3); and subjecting the billet provided with the hole to piercing-rolling from a front end thereof by means of a piercing machine. By this means, the generation of burrs and internal defects at the rear end of a hollow shell after piercing-rolling can be suppressed.

$$0.12 \leq D/B \leq 0.25 \quad (1)$$

$$0.10 \leq H/B \leq 0.20 \quad (2)$$

$$0.05 \leq L1/B \leq 0.10 \quad (3)$$

2 Claims, 6 Drawing Sheets

(58) Field of Classification Search
USPC ..... 72/97, 99, 100, 208
See application file for complete search history.

(56) References Cited

FOREIGN PATENT DOCUMENTS

| | | | | |
|---|---|---|---|---|
| JP | 2001-219205 | A | | 8/2001 |
| JP | 2015-167960 | A | | 9/2015 |
| JP | 2015167960 | | * | 9/2015 |
| WO | 2009/122620 | A1 | | 10/2009 |

OTHER PUBLICATIONS

JP2015167960 Goto, et alia (Sep. 28, 2015) MT (Year: 2015).*
English Abstract of JP-2001-219205A.
English Abstract of JP-2015-167960A.
English Abstract of JP-H07-214113A.
English Abstract of WO-2009-122620A1.

* cited by examiner

METHOD FOR PRODUCING SEAMLESS METAL PIPE

TECHNICAL FIELD

The present invention relates to a method for producing a seamless metal pipe. More specifically, the present invention relates to a method for producing a seamless metal pipe using a piercing machine.

BACKGROUND ART

One of the methods for producing a seamless metal pipe is one that uses a piercing machine. A piercing machine includes a plurality of skew rolls disposed at equal intervals around a pass line, and a plug disposed on the pass line between the plurality of skew rolls.

The method for producing a seamless metal pipe using a piercing machine is as described below. First, a heated round billet is prepared and placed on the pass line. The round billet is pushed in between the plurality of skew rolls using a pusher that is disposed in front of the piercing machine. Once the round billet is engaged with the plurality of skew rolls, the round billet is subjected to piercing-rolling by the skew rolls and the plug while the round billet is being spirally rotated, thereby producing a hollow shell.

During piercing-rolling, the plug pierces the round billet. When the plug nose comes out from the rear end of the round billet, a part of the entire rear end part of the round billet where the plug nose had been in contact with (hereunder, referred to as "contact portion") until immediately before the plug nose came out is broken through. The contact portion broken through remains as burrs on the inner surface or rear end of the hollow shell.

In some cases, after piercing-rolling, burrs fall off and accumulate inside the piercing machine. In such a case, it is necessary to periodically clean the inside of the piercing machine. In addition, if large burrs remain at the inner surface or rear end of the hollow shell, the burrs cause defects to arise in the inner surface of the hollow shell and a mandrel bar or the like during the subsequent process of elongation rolling.

Methods for suppressing the generation of burrs are disclosed in International Application Publication No. 2009/122620 (Patent Literature 1), Japanese Patent Application Publication No. 2001-219205 (Patent Literature 2), Japanese Patent Application Publication No. 2015-167960 (Patent Literature 3) and Japanese Patent Application Publication No. 07-214113 (Patent Literature 4).

According to the method disclosed in Patent Literature 1, a hole having a predetermined depth and having a plurality of grooves in the inner surface thereof is formed in the center part of the rear end of a round billet before piercing-rolling. One part of the shape of a prepared hole appears between adjacent grooves. The round billet in which the hole having a plurality of grooves is formed is subjected to piercing-rolling. When the nose of the plug breaks through the rear end of the round billet, the contact portion of the rear end face broken through attempts to form a protruding portion that may become the starting point of burrs. However, the grooves formed in the inner surface of the hole absorb the contact portion that can become a protruding portion. Further, by forming the hole, excess material that may increase the size of the protruding portion is removed. It is described in Patent Literature 1 that in this way the generation of burrs can be suppressed.

According to the methods disclosed in Patent Literature 2 and Patent Literature 3, a hole that does not have a groove of a predetermined depth is formed in the center part of the rear end of a round billet. The round billet in which the hole has been formed is subjected to piercing-rolling. It is described in the aforementioned Patent Literature 2 and Patent Literature 3 that, by forming the hole in the center part of the rear end of the round billet, excess material that may form burrs is removed, and thus the generation of burrs can be suppressed.

According to the method disclosed in Patent Literature 4, a round billet in which a strip groove having a "−" (minus) shape or a "+" (plus) shape is formed in the rear end face thereof is subjected to piercing-rolling. It is described in Patent Literature 4 that, because the strip groove having a minus shape or a plus shape is formed in the rear end face, the generation of burrs can be suppressed since there is no excess material or little excess material at the center region of the end face.

CITATION LIST

Patent Literature

Patent Literature 1: International Application Publication No. 2009/122620

Patent Literature 2: Japanese Patent Application Publication No. 2001-219205

Patent Literature 3: Japanese Patent Application Publication No. 2015-167960

Patent Literature 4: Japanese Patent Application Publication No. 07-214113

SUMMARY OF INVENTION

Technical Problem

However, with regard to the production of seamless metal pipes, it is desirable to further suppress the generation of burrs. Further, it is uncertain whether the methods disclosed in Patent Literature 1 to Patent Literature 4 can be applied to alloy steel, which has low deformability. In addition, a finding obtained by the present inventors indicated that when the measures for suppressing burrs according to the prior art are adopted, internal defects may arise at the inner surface of the hollow shell. Therefore, it is desirable to develop a method that simultaneously suppresses both burrs and internal defects.

An objective of the present invention is to provide a method for producing a seamless metal pipe that can suppress burrs and internal defects that are formed at the rear end of a hollow shell after piercing-rolling, even when using alloy steel that has low deformability.

Solution to Problem

A method for producing a seamless metal pipe according to the present embodiment uses a piercing machine including a plurality of skew rolls and a plug arranged between the plurality of skew rolls. The method for producing a seamless metal pipe includes the steps of: preparing a billet having a diameter B (mm); heating the billet; forming, in a center part of a rear end of the heated billet, a hole including four grooves extending in an axial direction of the billet, the grooves each having a groove width D (mm) satisfying Formula (1), a groove height H (mm) satisfying Formula (2), and a groove depth L1 (mm) satisfying Formula (3); and subjecting the billet provided with the hole to piercing-rolling from a front end by means of the piercing machine.

$$0.12 \leq D/B \leq 0.25 \quad (1)$$

$$0.10 \leq H/B \leq 0.20 \quad (2)$$

$$0.05 \leq L1/B < 0.10 \quad (3)$$

Advantageous Effects of Invention

According to the present invention, burrs and internal defects that arise at the rear end of a hollow shell after piercing-rolling can be suppressed, even when using alloy steel that has low deformability.

DESCRIPTION OF EMBODIMENTS

The present embodiment is described in detail below. The same reference symbols will be used throughout the drawings to refer to the same or like parts, and description thereof will not be repeated. The following description is given based on the premise that a round billet composed of steel (hereinafter, referred to simply as "billet") is subjected to piercing-rolling and a seamless pipe is thereby produced.

[Generation of Burrs]

Burrs and internal defects that are generated at the rear end of a hollow shell after piercing-rolling will now be described.

Figure 1:
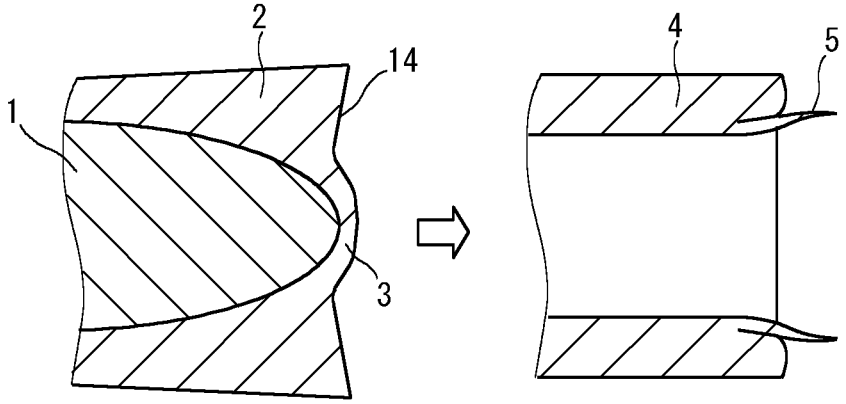
FIG. 1 is a cross-sectional view illustrating the generation of burrs.

FIG. 1 is a cross-sectional view illustrating the manner in which burrs are generated. In FIG. 1, a case of performing piercing-rolling of a billet which does not have a hole formed in the rear end part thereof is illustrated. Referring to FIG. 1, during piercing-rolling, when the nose of a plug 1 comes out from a rear end face 14 of a billet 2, a portion (contact portion) 3 which had been in contact with the nose of the plug 1 until immediately before the nose of the plug 1 came out from the rear end face 14 is broken through. The contact portion 3 is excess material with respect to a hollow shell 4. Accordingly, the contact portion 3 broken through by the plug 1 remains as burrs 5 on the inner surface or the rear end of the hollow shell 4.

Figure 2:
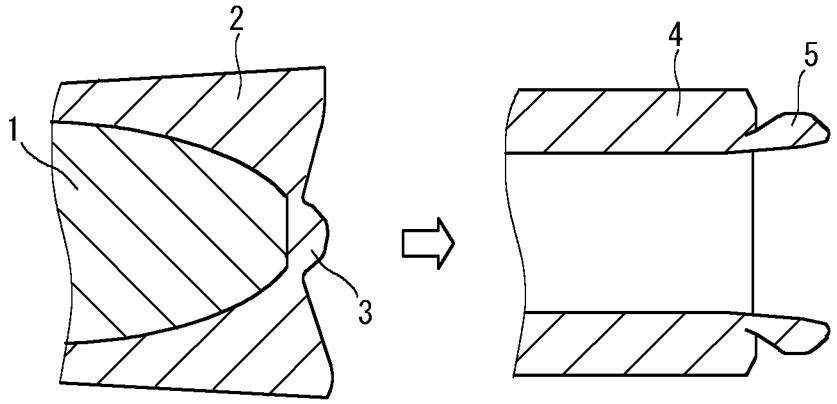
FIG. 2 is a cross-sectional view illustrating the generation of large burrs.

FIG. 2 is a cross-sectional view illustrating the generation of large burrs. In FIG. 2, a case of subjecting a billet in which a hole is not formed in the rear end part thereof to piercing-rolling is illustrated. In FIG. 2, a billet 2 is subjected to piercing-rolling by a plug 1 whose nose is flat. Referring to FIG. 2, in the case of the plug 1 whose nose is flat, the volume of the contact portion 3 is larger than in the case of a plug whose nose is pointed or rounded (see FIG. 1). Therefore, the contact portion 3 broken through by the plug 1 remains as burrs 5 whose volume is larger than the volume of the burrs illustrated in FIG. 1.

The generation of such burrs is due to the existence of excess material at the rear end part of the billet. To suppress the generation of burrs, a method is available that uses a billet which has a hole formed in the rear end part thereof. However, if a hole is merely provided in the billet, there is a possibility that internal defects or deposits may be generated.

[Generation of Internal Defects]

Figure 3:
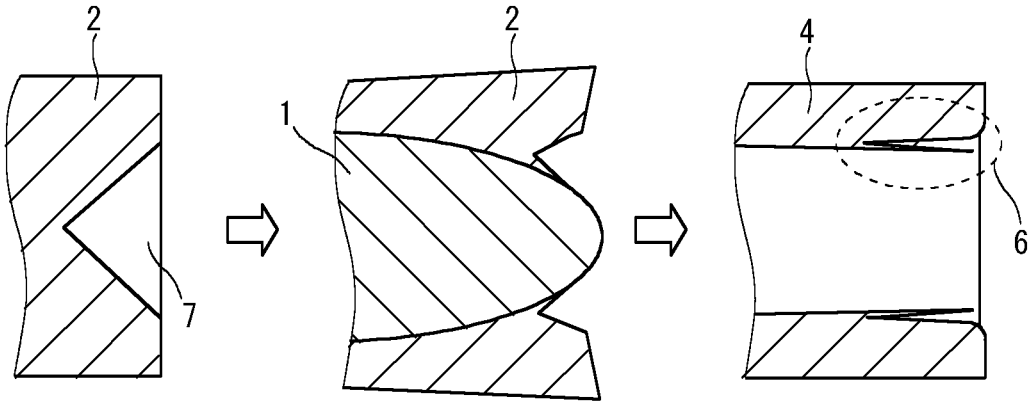
FIG. 3 is a cross-sectional view illustrating piercing-rolling of a billet having a cone-shaped hole formed in a rear end part thereof.

FIG. 3 is a cross-sectional view illustrating piercing-rolling of a billet having a cone-shaped hole formed in a rear end part thereof. Referring to FIG. 3, in a billet 2 having a cone-shaped hole 7 formed in the rear end part thereof, excess material that is a cause of burrs has been removed in an amount that corresponds to the volume of the hole 7. Therefore, it is less likely for burrs to be generated. However, when the billet 2 that has the cone-shaped hole 7 formed in the rear end part thereof is subjected to piercing-rolling, internal defects 6 may be generated at the inner surface of the hollow shell 4.

[Generation of Deposits]

Figure 4:
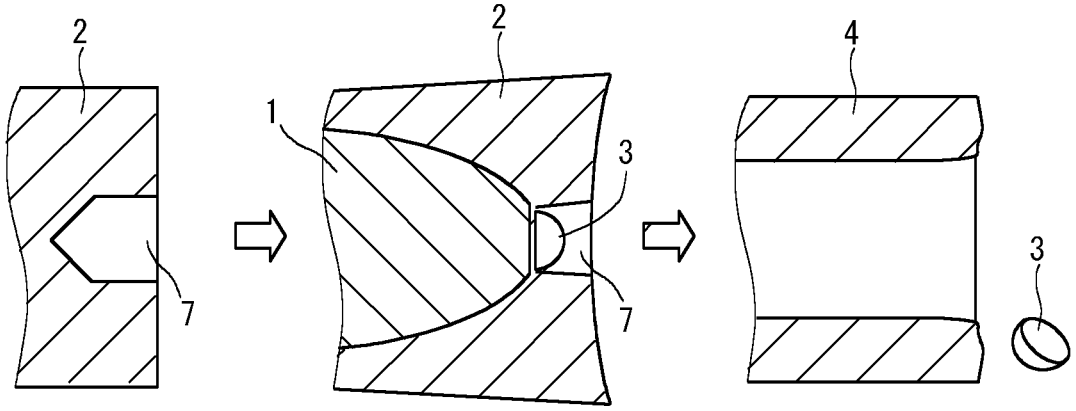
FIG. 4 is a cross-sectional view illustrating piercing-rolling of a billet having a cylindrical hole formed in a rear end part thereof.

FIG. 4 is a cross-sectional view illustrating piercing-rolling of a billet having a cylindrical hole formed in a rear end part thereof. Referring to FIG. 4, in a billet 2 having a cylindrical hole 7 formed in the rear end part thereof, excess material has been removed in an amount that corresponds to the volume of the hole 7. Therefore, it is less likely for burrs to be generated. However, for example, in a case where the billet 2 is subjected to piercing-rolling by a plug 1 whose nose is flat, the contact portion 3 at the nose of the plug 1 is liable to be separated from the hollow shell 4. Because the separated contact portions 3 accumulate in the piercing machine, regular cleaning is necessary.

In this regard, as disclosed in Patent Literature 1, if a billet in which a hole having a groove is formed in the rear end part thereof is subjected to piercing-rolling, the generation of burrs is basically suppressed because a contact portion that is the cause of burrs is absorbed into the groove. However, depending on the shape of the hole and the deformability of the billet and the like, burrs or internal defects may remain in some cases. Therefore, it is desirable to more reliably suppress the generation of both burrs and internal defects. Further, a seamless metal pipe to be used in oil wells and the like is required to have strength, corrosion resistance and the like. Therefore, billets composed of alloy steel having high strength and corrosion resistance are sometimes used to produce seamless metal pipes. However, the deformability of alloy steel is low in comparison to carbon steel. When the deformability of a billet is low, a large burr is liable to be generated, and in some cases the entire burr cannot fit completely into a groove. Accordingly, there is a need to produce seamless metal pipes composed of alloy steel without generating burrs and internal defects.

Therefore, in order to realize suppression of both burrs and internal defects, the present inventors conducted studies regarding the detailed shapes of holes having grooves that are formed in the rear end part of a billet.

The groove that absorbs the contact portion that gives rise to burrs is important for suppressing the formation of burrs. Accordingly, it is conceivable to make the depth of the groove deep to make it easier to absorb burrs. However, as illustrated in an example that is described later, it has been found that if the depth of the groove is made deep, internal defects are liable to occur at the inner surface of the hollow shell after piercing-rolling. In the present description, the term "depth of the groove" means the length of the groove along the axial direction of the billet.

Figure 5:
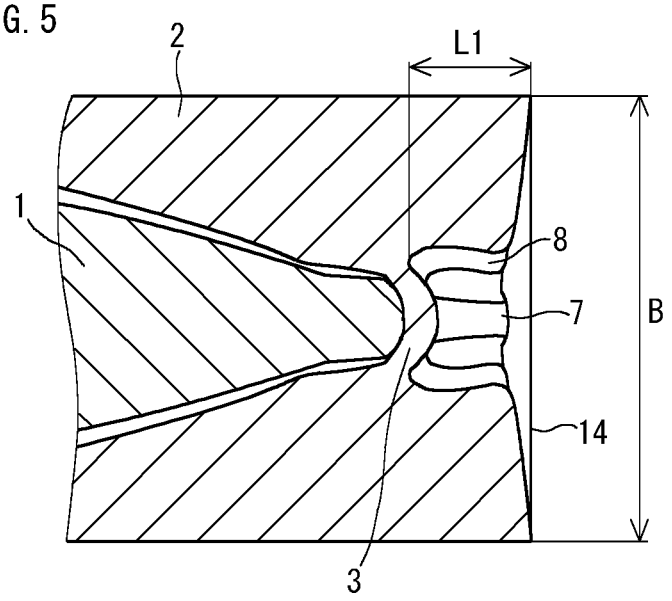
FIG. 5 is a cross-sectional view illustrating a state during piercing-rolling of a billet having a deep groove in a rear end part thereof.

FIG. 5 is a cross-sectional view illustrating a state during piercing-rolling of a billet having a deep groove in a rear end part thereof. Referring to FIG. 5, in a case where a depth L1 of a groove 8 is deep relative to a diameter B of a billet 2, the contact portion 3 is broken through before reaching the vicinity of the rear end face 14. When the plug 1 advances further toward the rear end of the billet 2, the contact portion 3 broken through is rolled by the plug 1. Therefore, internal defects are liable to be generated at the inner surface of the hollow shell after piercing-rolling.

Figure 6:
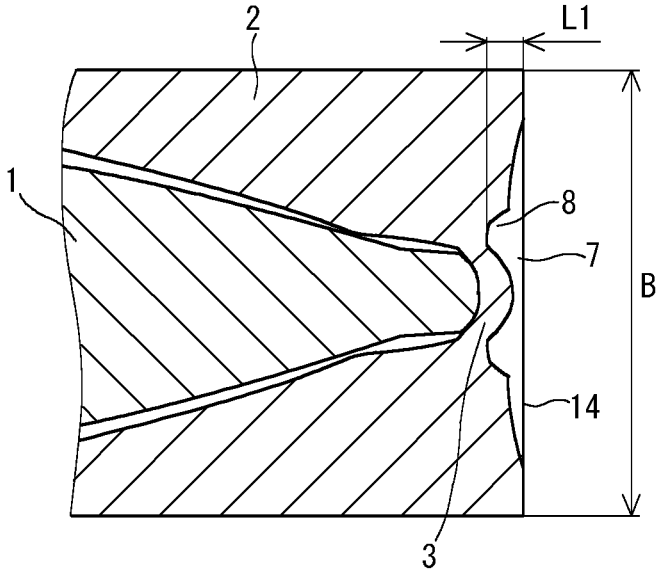
FIG. 6 is a cross-sectional view illustrating a state during piercing-rolling of a billet having a shallow groove in a rear end part thereof.

FIG. 6 is a cross-sectional view illustrating a state during piercing-rolling of a billet having a shallow groove in a rear end part thereof. Referring to FIG. 6, in a case where the depth L1 of the groove 8 is shallow relative to the diameter B of the billet 2, the contact portion 3 is broken through in the vicinity of the rear end face 14 of the billet 2. In this case, it is difficult for the contact portion 3 broken through to be rolled by the plug 1. Therefore, it is less likely for internal defects to arise at the inner surface of the hollow shell after piercing-rolling. However, if the depth L1 of the groove 8 is too shallow, burrs will be generated since it will be difficult for the contact portion 3 to fit into the groove 8 (see FIG. 1).

Therefore, the present inventors conducted intensive studies with regard to a method for suppressing the generation of both internal defects and burrs. As a result, the present inventors found that even in a case where a groove is shallow, by devising an appropriate design for the groove shape, the groove 8 can absorb the contact portion 3 broken through by the plug 1. More specifically, the present inventors discovered that the generation of burrs can be suppressed if the groove width and groove height are an appropriate shape. Further, the present inventors discovered that the generation of internal defects can also be suppressed if the groove depth is moderately shallow. In addition, by means of the aforementioned findings, the present inventors discovered that the generation of burrs and internal defects can be suppressed even in the case of alloy steel, and not just carbon steel.

The method for producing a seamless metal pipe of the present invention has been completed based on the above findings. The method for producing a seamless metal pipe according to the present embodiment uses a piercing machine including a plurality of skew rolls and a plug arranged between the plurality of skew rolls. The method for producing a seamless metal pipe includes the steps of: preparing a billet having a diameter B (mm); heating the billet; forming, in a center part of a rear end of the heated billet, a hole including four grooves extending in an axial direction of the billet, the grooves each having a groove width D (mm) satisfying Formula (1), a groove height H (mm) satisfying Formula (2), and a groove depth L1 (mm) satisfying Formula (3); and subjecting the billet provided with the hole to piercing-rolling from a front end by means of the piercing machine.

$$0.12 \leq D/B \leq 0.25 \quad (1)$$

$$0.10 \leq H/B \leq 0.20 \quad (2)$$

$$0.05 \leq L1/B \leq 0.10 \quad (3)$$

In the production method of the present embodiment, a billet in which a hole having a groove is formed in the center part of the rear end thereof is subjected to piercing-rolling. In order to satisfy Formula (1) and Formula (2), the shape of the hole is a cross shape as viewed in the axial direction. Further, as illustrated in an example that is described later, because a groove that satisfies Formula (1) and Formula (2) is a moderate size, the groove can absorb a contact portion broken through by a plug. Thus, it is less likely for burrs to be formed in the hollow shell after piercing-rolling. The shape of the groove also satisfies Formula (3). As illustrated in an example that is described later, in the case of a groove that satisfies Formula (3), the contact portion is broken through in the vicinity of the rear end face of the billet. That is, the contact portion is broken through at a shallow position of the hole of the billet. Consequently, the contact portion broken through is not liable to be rolled by the plug, or a time period for which the contact portion broken through is rolled by the plug is short. Therefore, it is less likely for internal defects to arise at the inner surface of the hollow shell. Suppressing the generation of burrs makes it less likely for burrs to accumulate in the piercing machine. Further, performing elongation rolling of a hollow shell with the generation of burrs and internal defects being suppressed means that it is less likely for defects to arise at the inner surface of the seamless metal pipe and also in tools (for example, a mandrel bar) of a rolling mill.

Preferably, L2 (mm) satisfies Formula (4), where L2 is a distance that is twice a maximum distance from a rear end center of the billet to a groove bottom face on the rear end face of the billet.

$$0.30 \leq L2/B \leq 0.60 \quad (4)$$

L2/B represents a ratio of the maximum width of the hole with respect to the billet diameter at the rear end face of the billet. Therefore, a small value of L2/B indicates a small hole, and a large value of L2/B indicates a large hole. When L2/B is small, it is difficult for the contact portion broken through by the plug to be absorbed in a groove. When L2/B is large, the time spent on working to form the hole will increase since the groove will be excessively large. Further, in a case of forming the hole by press working, the press load will increase. Therefore, as illustrated in an example that is described later, preferably L2/B is within a predetermined range (Formula (4)).

Preferably, as seen from the axial direction of the billet, four grooves are provided in a cross shape, and the four grooves extend from the rear end face of the billet.

In the present description, the phrase "four grooves are a cross shape" means that, as seen from the axial direction of the billet, the grooves are disposed at equal intervals around the axial centerline of the billet, and two grooves that are adjacent in the circumferential direction are orthogonal. Providing four cross-shaped grooves that extend from the rear end face of the billet in this manner means that the cross-sectional shape of the hole is constant from the rear end face. In this case, the hole can easily be formed.

The production method of the present embodiment can be applied, for example, to an alloy steel containing, in mass %, Cr: 1 to 12%. Further, since burrs are less liable to occur in carbon steel compared to alloy steel, naturally the production method of the present embodiment can also suppress the generation of burrs and internal defects in carbon steel.

As illustrated in an example that is described later, by forming the hole in an appropriate shape, even in the case of a billet composed of alloy steel heated to less than 1300° C., piercing-rolling can be performed in which the generation of burrs and internal defects is suppressed. By this means, a decrease in the energy unit requirement in a heating process can be suppressed.

[Production Method]

Hereunder, the production method for producing a seamless metal pipe of the present embodiment is described. The production method includes a preparation process, a heating process, a forming process and a piercing-rolling process.

[Preparation Process]

In the preparation process, a billet having a diameter B (mm) is prepared. The material of the billet is, for example, steel. The billet is produced by, for example, a continuous casting process or an ingot-making process. The diameter of the billet is not particularly limited. However, in general, the diameter of a billet to be produced into a seamless metal pipe is in the range of 20 to 400 (mm).

[Heating Process]

In the heating process, the billet is heated in a heating furnace. The heating temperature is not particularly limited. However, from the viewpoint of suppressing a decrease in the energy unit requirement, the heating temperature is preferably less than 1300° C. Further, from the viewpoint of the deformability of the billet, the heating temperature is preferably 1100° C. or more.

[Forming Process]

Figure 7:
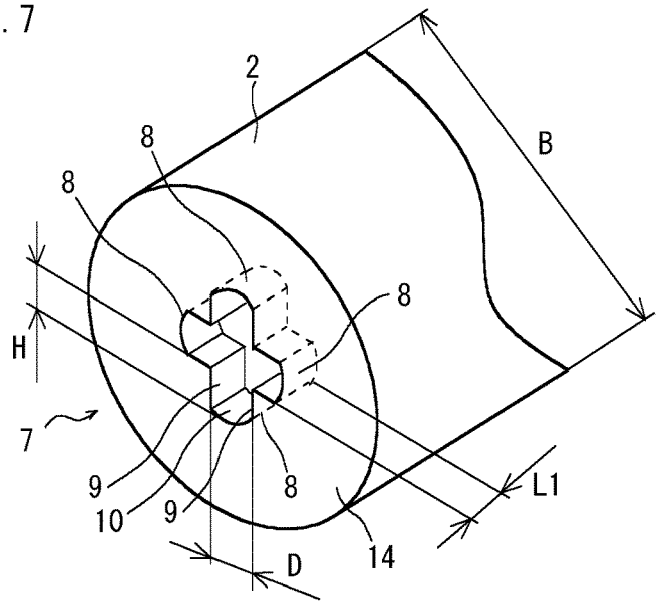
FIG. 7 is a perspective view of a billet of the present embodiment.

FIG. 7 is a perspective view of a billet of the present embodiment. Referring to FIG. 7, in the forming process a hole 7 is formed in the center part of the rear end of the billet 2. The hole 7 extends in the axial direction of the billet 2 from a rear end face 14. The hole 7 includes four grooves 8 extending in the axial direction of the billet 2 from the rear end face 14. The four grooves 8 are disposed at equal intervals around the axial centerline of the billet 2. The four grooves 8 each have the same shape. Therefore, hereunder one groove among the four grooves 8 is described.

[Hole Shape]

Each groove 8 has a groove width D (mm) that satisfies Formula (1), a groove height H (mm) that satisfies Formula (2), and a groove depth L1 (mm) that satisfies Formula (3). Here, the term "groove width D" means the distance between two groove side-faces 9. The term "groove height H" means the distance from an end of the groove side-face 9 to a groove bottom face 10. The term "groove depth L1" means the distance of the groove 8 in the axial direction of the billet.

$$0.12 \leq D/B \leq 0.25 \quad (1)$$

$$0.10 \leq H/B \leq 0.20 \quad (2)$$

$$0.05 \leq L1/B \leq 0.10 \quad (3)$$

Formula (1) will now be described. As illustrated in an example that is described later, if D/B is less than 0.12, because the groove width D is small, it is difficult for the groove to absorb the contact portion broken through by the plug. Therefore, the lower limit of D/B is 0.12. Preferably, the lower limit of D/B is 0.15, and more preferably is 0.17. If D/B is greater than 0.25, because the groove width D is large, the shape of the hole having the grooves comes close to the shape of a circle as viewed in the axial direction. Consequently, it is difficult to obtain the effect whereby the contact portion is absorbed by the groove. Accordingly, the upper limit of D/B is 0.25. Preferably the upper limit of D/B is 0.23.

Formula (2) will now be described. If H/B is less than 0.10, because the groove height H is low, it will be difficult for the groove to absorb the contact portion broken through by the plug. Therefore, the lower limit of H/B is 0.10. Preferably, the lower limit of H/B is 0.12. If H/B is greater than 0.20, because the groove height H is high, an excessively large air gap will be rolled, and folded imperfections or cracks are liable to occur. Therefore, the upper limit of H/B is 0.20. Preferably, the upper limit of H/B is 0.16.

Formula (3) will now be described. If L1/Bis less than 0.05, because the groove depth L1 will be shallow, the capacity of the groove will not be sufficient for absorbing the contact portion broken through by the plug. Therefore, the lower limit of L1/Bis 0.05. Preferably, the lower limit of L1/Bis 0.07. If L1/Bis 0.10 or more, as illustrated in an example described later, because the groove depth L1 is deep, internal defects are liable to occur at the inner surface of the hollow shell after piercing-rolling. Therefore, the upper limit of L1/Bis 0.10. Preferably, the upper limit of L1/Bis 0.09.

Figure 8:
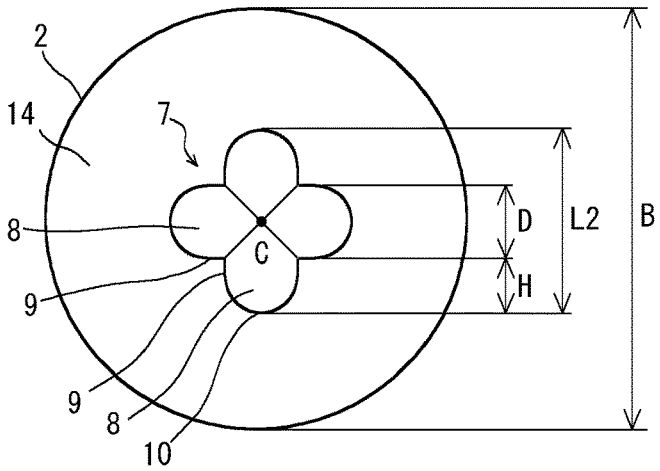
FIG. 8 is a front view of the billet of the present embodiment.
Figure 10:
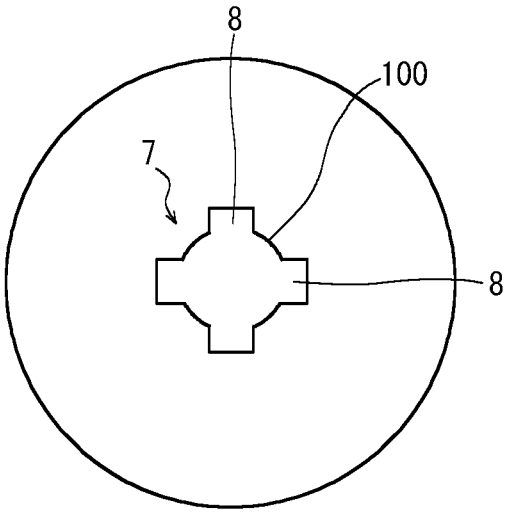
FIG. 10 is a front view of a billet in which a hole having a common groove is formed.

FIG. 8 is a front view of the billet of the present embodiment. The shape of the hole as seen from the axial direction of the billet 2 will now be described referring to FIG. 8. Because the grooves 8 satisfy Formula (1) and Formula (2), the shape of the hole 7 of the billet 2 is a cross shape. Each groove side-face 9 of the groove 8 is parallel with the radial direction of the billet 2, and among the two ends of the groove side-face 9, an end that is nearer to a rear end center C connects with an end that is nearer to the rear end center C of the groove side-face 9 of another groove 8 that is adjacent thereto. That is, one part 100 of the shape of a prepared hole does not appear between adjacent grooves 8 (see FIG. 10). The groove bottom face 10 is a round shape. However, the shape of the groove bottom face 10 is not limited thereto. The shape of the groove bottom face 10 may be flat, for example.

Figure 9:
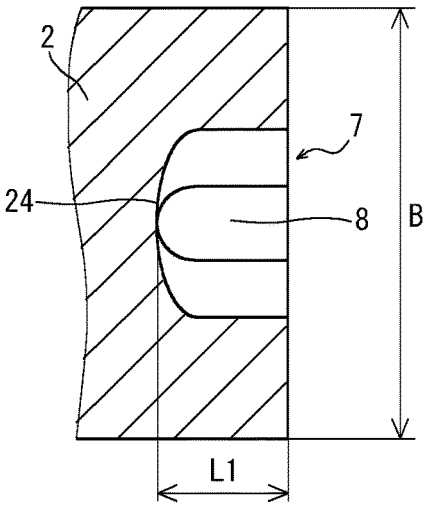
FIG. 9 is a cross-sectional view of the billet of the present embodiment.

FIG. 9 is a cross-sectional view of the billet of the present embodiment. The shape in the depth direction of the hole of the billet 2 will now be described referring to FIG. 9. Because the groove 8 satisfies Formula (3), the groove 8 is shallow in comparison to the grooves of the prior art. A front end face 24 of the groove 8 is a round shape. However, the shape of the front end face 24 of the groove 8 is not limited thereto. The shape of the front end face 24 of the groove 8 may be flat. The groove 8 extends in parallel with the axial direction of the billet 2. However, the direction in which the groove 8 extends needs not be parallel with the axial direction of the billet 2. For example, the groove 8 may become gradually smaller toward the front end face 24. Even in such a case, the groove 8 satisfies Formula (1) and Formula (2) at a cross-section at an arbitrary position as seen from the axial direction.

Figure 11:
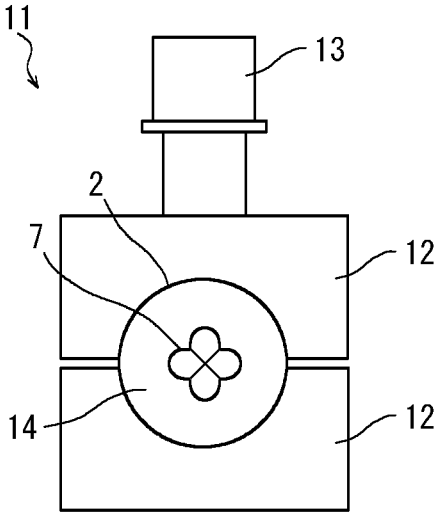
FIG. 11 is a view illustrating a process for forming a hole in the center part of the rear end of a billet.

FIG. 11 is a view illustrating a process for forming the hole in the center part of the rear end of the billet. Referring to FIG. 11, after extracting the billet 2 from the heating furnace, the billet 2 is clamped by a clamp die 11. The clamp die 11 includes a pair of dies 12 having a circular orifice, and a driving apparatus 13 that raises and lowers the one die 12.

A punch that is attached to the front end of a hydraulic cylinder which is not shown in the drawing is thrust into the center part of the rear end face 14 of the clamped billet 2. By this means, the hole 7 is formed. The hole 7 may also be formed by machining or by press working. In addition, the hole 7 may be formed by melting the center part of the rear end of the billet 2 using plasma gas or the like.

[Piercing-Rolling Process]

Figure 12:
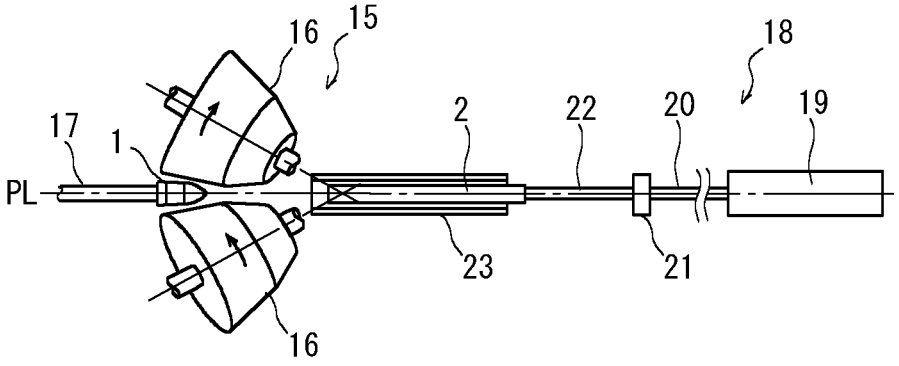
FIG. 12 is a view illustrating a piercing-rolling process.

FIG. 12 is a view illustrating a piercing-rolling process. Referring to FIG. 12, after the hole is formed in the billet 2, the billet 2 is subjected to piercing-rolling using a piercing machine 15. The piercing machine 15 includes two cone-shaped skew rolls (hereinafter, referred to simply as "skew rolls") 16, a plug 1, and a mandrel 17.

The two skew rolls 16 are disposed facing each other so as to sandwich a pass line PL therebetween. Each of the skew rolls 16 has a feed angle and a cross angle with respect to the pass line PL. The plug 1 is disposed on the pass line PL between the two skew rolls 16. The mandrel 17 is disposed along the pass line PL on the delivery side of the piercing machine 15. The front end of the mandrel 17 is connected to the rear end of the plug 1.

A pusher 18 is disposed along the pass line PL in front of the entry side of the piercing machine 15. The pusher 18 includes a cylinder main body 19, a cylinder shaft 20, a connection member 21, and a billet pushing rod 22. The billet pushing rod 22 is connected to the cylinder shaft 20 by the connection member 21 so as to be rotatable in the circumferential direction. The connection member 21 includes a bearing for allowing the billet pushing rod 22 to rotate in the circumferential direction.

The cylinder main body 19 that is a driving apparatus is of a hydraulic type or an electric motor-driven type, and causes the cylinder shaft 20 to advance or retreat. The pusher 18 causes the front end face of the billet pushing rod 22 to butt against the rear end face of the billet 2, and pushes the billet 2 forward from the rear by causing the cylinder shaft 20 and the billet pushing rod 22 to advance by means of the cylinder main body 19.

An entrance guide 23 is arranged on the pass line PL between the pusher 18 and the skew rolls 16. The entrance guide 23 suppresses deviation of the billet 2 from the pass line PL while the billet 2 is being pushed by the pusher 18 and is advancing.

The billet 2 in which the hole having grooves is formed is placed on the pass line PL between the skew rolls 16 and the pusher 18. At this time, the rear end face of the billet 2 faces the pusher 18, and the front end face of the billet 2 faces the plug 1.

The pusher 18 pushes the billet 2 forward along the pass line PL to thereby push the billet 2 in between the two skew rolls 16. The billet 2 is engaged with the two skew rolls 16. The billet 2 advances while being spirally rotated by the skew rolls 16. The plug 1 is pushed into the axial centerline of the billet 2. Thus, the billet 2 is subjected to piercing-rolling by the plug 1 and the skew rolls 16. A hollow shell is obtained by subjecting the billet 2 to piercing-rolling.

After the piercing-rolling process, the hollow shell is rolled by a mandrel mill, an elongator, a sizing mill or the like, to thereby produce a seamless metal pipe.

Referring to FIG. 8, on the rear end face 14 of the billet 2, it is preferable that L2 (mm) satisfies Formula (4), where L2 is a distance that is twice the maximum distance from the rear end center C of the billet 2 to the groove bottom face 10. The term "rear end center C of the billet 2" refers to the axial centerline of the billet 2 on the rear end face 14 of the billet 2.

$$0.30 \leq L2/B \leq 0.60 \quad (4)$$

L2/B represents the ratio of the maximum width of the hole 7 with respect to the billet diameter B at the rear end face 14 of the billet 2. If L2/B is small, it will be difficult for the contact portion broken through by the plug to be absorbed in the groove. If L2/B is large, the time spent on working to form the hole 7 will increase since the groove 8 will be excessively large. Further, in the case of forming the hole 7 by press working, the press load will increase. Therefore, as illustrated in an example that is described later, preferably L2/B is within a predetermined range.

The billet 2 may be, for example, a steel containing, in mass %, Cr: 1 to 12% (hereunder, also referred to as "alloy steel"). A seamless metal pipe to be used in oil wells or the like is required to have strength, corrosion resistance and the like. Since an alloy steel has high strength, corrosion resistance and the like, an alloy steel is suitable as the material of a seamless metal pipe to be used in oil wells or the like. On the other hand, the deformability of alloy steel is low. When the deformability of the billet is low, a large burr is liable to be generated, and in some cases the entire burr cannot fit completely in a groove. However, as illustrated in an example that is described later, according to the production method of the present embodiment, a seamless metal pipe can be produced in a manner in which the generation of burrs is suppressed even when the billet is composed of alloy steel, and not just carbon steel.

Figure 13:
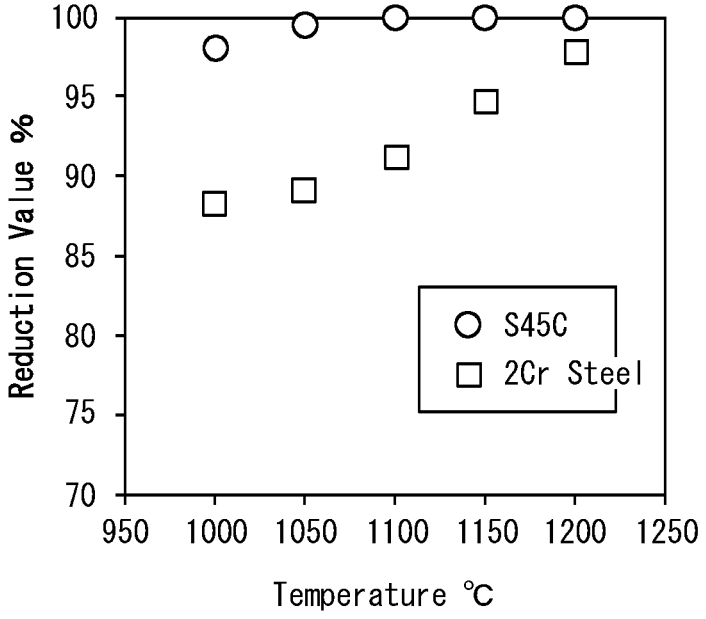
FIG. 13 is a view illustrating the relation between reduction values and temperatures of steels that have different compositions.

FIG. 13 is a view illustrating the relation between reduction values and temperatures of steels of different compositions. More specifically, FIG. 13 shows results of tensile tests performed on various kinds of steels that were heated to various temperatures. In FIG. 13, the ordinate represents reduction values (%), and the abscissa represents temperatures (° C.) of the steels. In FIG. 13, circular marks indicate results for carbon steel (S45C), and square marks indicate results for alloy steel (2Cr steel). Note that, a "reduction value" is calculated by the following equation.

(Reduction value [%])=((cross-sectional area before tensile test of broken-off portion)−(cross-sectional area of broken-off portion in tensile test))/(cross-sectional area before tensile test of broken-off portion)×100

It is known that when a reduction value shown in FIG. 13 is less than 95%, burrs are liable to arise after piercing-rolling because the deformability of the billet is low. Referring to FIG. 13, it is found that while in the case of carbon steel the reduction value is 95% or more when the temperature is in the range of 1000° C. or more, in the case of alloy steel the reduction value decreases extremely if the temperature is less than 1200° C. That is, it is clear that the deformability of alloy steel is low in comparison to carbon steel. In the case of alloy steel, the temperature at which the reduction value becomes 95% or more is approximately 1200° C. Accordingly, when subjecting a billet composed of alloy steel to piercing-rolling, it is desirable that the temperature of the billet is 1200° C. or more. To achieve this, it is necessary to heat the billet to 1300° C. or more in the heating process. The reason is that the temperature of the end face of the billet falls by approximately 100 to 200° C. while the billet is being conveyed from the heating furnace to the piercing machine. Heating the billet to 1300° C. or more causes the energy unit requirement to decrease.

However, according to the production method of the present embodiment, a billet containing a hole that has grooves is used. As illustrated in an example described later, if the hole is formed in an appropriate shape, piercing-rolling can be performed in a manner that suppresses the generation of burrs irrespective of the heating temperature of the billet, that is, even if the billet is composed of alloy steel which has been heated to less than 1300° C. Thus, a decrease in the energy unit requirement can be suppressed during production of a seamless metal pipe.

EXAMPLE

The present inventors produced hollow shells by piercing-rolling in which the shape of a hole formed in the center part of the rear end of the billets was changed in various ways. More specifically, each billet was heated, and various holes having grooves shown in Table 2 were formed in the center part of the rear end of the respective billets. The hole of each billet had four grooves. The four grooves of each billet were disposed at equal intervals in the circumferential direction of the billet. The heating temperature of the billets was 1245° C. The heated billets were subjected to piercing-rolling using a piercing machine to thereby produce hollow shells. The diameter of each hollow shell was 82 mm, and the wall thickness was 11 mm. The thus-produced hollow shells were evaluated by the present inventors with respect to the generation of burrs and internal defects by visual observation.

Table 1 shows the composition of the billets used in the present example.

TABLE 1

| Chemical Composition (Unit is mass %; balance is Fe and impurities) | | | | | | | |
|---|---|---|---|---|---|---|---|
| C | Si | Mn | P | S | Cr | Mo | W |
| 0.05 | 0.3 | 0.3 | 0.02 | 0.005 | 2.3 | 0.2 | 1.6 |

Table 2 shows the shapes of the holes formed in the center part of the rear end of the billets, and the evaluation results with respect to whether or not burrs and internal defects were generated. In Table 2, the columns "groove depth L1/B", "maximum hole diameter L2/B", "groove width DB" and "groove height H/B" show values nondimensionalized by the billet diameter (B=70 mm). In the evaluation column in Table 2, the characters "NG" indicate that burrs or internal defects were generated, the character "A" indicates that allowable small burrs or internal defects were generated, and the character "G" indicates that burrs and internal defects were not generated.

TABLE 2

| | Groove Depth L1/B | Maximum Hole Diameter L2/B | Groove Width D/B | Groove Height H/B | Evaluation |
|---|---|---|---|---|---|
| Test No. 1 | 0.300 | 0.314 | 0.086 | 0.114 | NG |
| Test No. 2 | 0.300 | 0.429 | 0.114 | 0.157 | NG |
| Test No. 3 | 0.300 | 0.429 | 0.171 | 0.129 | NG |
| Test No. 4 | 0.200 | 0.429 | 0.114 | 0.157 | NG |
| Test No. 5 | 0.200 | 0.429 | 0.171 | 0.129 | NG |
| Test No. 6 | 0.143 | 0.429 | 0.114 | 0.157 | NG |
| Test No. 7 | 0.143 | 0.429 | 0.171 | 0.129 | NG |
| Test No. 8 | 0.143 | 0.429 | 0.229 | 0.100 | NG |
| Test No. 9 | 0.100 | 0.429 | 0.229 | 0.100 | G |
| Test No. 10 | 0.100 | 0.429 | 0.114 | 0.157 | A |
| Test No. 11 | 0.100 | 0.429 | 0.143 | 0.143 | G |

TABLE 2-continued

| | Groove Depth L1/B | Maximum Hole Diameter L2/B | Groove Width D/B | Groove Height H/B | Evaluation |
|---|---|---|---|---|---|
| Test No. 12 | 0.100 | 0.429 | 0.171 | 0.129 | G |
| Test No. 13 | 0.057 | 0.429 | 0.114 | 0.157 | A |
| Test No. 14 | 0.057 | 0.429 | 0.171 | 0.129 | G |
| Test No. 15 | 0.057 | 0.429 | 0.229 | 0.100 | G |

In Test Nos. 1, 4 and 5, large burrs were generated at the rear end of the hollow shell.

In Test Nos. 2 and 3, internal defects were generated on the inner surface of the hollow shell.

In Test Nos. 6 to 8, burrs were generated at the rear end of the hollow shell, and internal defects were generated on the inner surface.

In Test Nos. 10 and 13, allowable small burrs were generated at the rear end of the hollow shell.

In Test Nos. 9, 11, 12, 14 and 15, almost no burrs or internal defects were generated in the hollow shell.

Based on the present example, the present inventors reached the following conclusions. Based on the results of Test Nos. 1 to 8, the shallower the groove depth L1/B formed in the center part of the rear end of the billet is, the greater the degree to which the generation of internal defects was suppressed is. Further, based on Test No. 10, when the groove width DB was small, it was difficult for the contact portion broken through by the plug to be absorbed in the groove, and burrs were easily generated.

An embodiment of the present invention has been described above. However, the foregoing embodiment is merely an example for implementing the present invention. Accordingly, the present invention is not limited to the above embodiment, and the above embodiment can be appropriately modified and implemented within a range that does not deviate from the gist of the present invention.

REFERENCE SIGNS LIST

1: Plug
2: Billet
3: Contact Portion
4: Hollow Shell
5: Burr
6: Internal defect
7: Hole
8: Groove
9: Groove Side-Face
10: Groove Bottom Face
11: Clamp Die
12: Die
13: Driving Apparatus
14: Rear End Face
15: Piercing Machine
16: Skew Roll
17: Mandrel
18: Pusher
19: Cylinder Main Body
20: Cylinder Shaft
21: Connection Member
22: Billet Pushing Rod
23: Entrance Guide
24: Front End Face

The invention claimed is:

1. A method for producing a seamless metal pipe using a piercing machine including a plurality of skew rolls and a plug arranged between the plurality of skew rolls, the method comprising the steps of:

preparing a billet having a diameter B (mm), heating the billet, forming, in a center part of a rear end of the heated billet, a hole including four grooves extending in an axial direction of the billet, the grooves each having a groove width D (mm) satisfying Formula (1), a groove height H (mm) satisfying Formula (2) and a groove depth L1 (mm) satisfying Formula (3), and subjecting the billet provided with the hole to piercing-rolling from a front end by means of the piercing machine, wherein the four grooves are provided in a cross shape as seen from an axial direction of the billet, the four grooves extend from the rear end face of the billet, the grooves are disposed at equal intervals around the axial centerline of the billet, and two grooves that are adjacent in the circumferential direction are orthogonal, and wherein each groove side-face of the groove is parallel with the radial direction of the billet, and among the two ends of the groove side-face, an end that is nearer to a rear end center connects with an end that is nearer to the rear end center of the groove side-face of another groove that is adjacent thereto:

$$0.12 \leq D/B \leq 0.25 \quad (1)$$

$$0.10 \leq H/B \leq 0.20 \quad (2)$$

$$0.05 \leq L1/B \leq 0.10 \quad (3).$$

2. The method for producing a seamless metal pipe according to claim 1, wherein:

L2 (mm) satisfies Formula (4), where L2 is a distance that is twice a maximum distance from a rear end center of the billet to a groove bottom face on a rear end face of the billet;

$$0.30 \leq L2/B \leq 0.60 \quad (4).$$

* * * * *